US005214243A

United States Patent [19]

Johnson

[11] Patent Number: 5,214,243

[45] Date of Patent: May 25, 1993

[54] HIGH-TEMPERATURE, LOW-NOISE COAXIAL CABLE ASSEMBLY WITH HIGH STRENGTH REINFORCEMENT BRAID

[75] Inventor: Robert B. Johnson, Laguna Beach, Calif.

[73] Assignee: Endevco Corporation, San Juan Capistrano, Calif.

[21] Appl. No.: 774,690

[22] Filed: Oct. 11, 1991

[51] Int. Cl.[5] ..... H01B 11/18; H01R 4/28

[52] U.S. Cl. ..... 174/36; 29/857; 29/862; 174/74 R; 174/75 C; 174/102 SC; 174/106 SC; 439/578

[58] Field of Search ..... 174/36, 102 R, 102 SC, 174/106 SC, 106 R, 74 R, 74 A, 75 C, 75 R; 29/857, 860, 862; 439/578

[56] References Cited

U.S. PATENT DOCUMENTS

| | | | |
|---|---|---|---|
| 2,142,625 | 1/1939 | Zoethout | 174/106 SC |
| 2,447,168 | 8/1948 | Dean et al. | 174/36 |
| 2,622,152 | 12/1952 | Rosch | 174/36 |
| 3,230,299 | 1/1966 | Radziejowski | 174/106 R |
| 3,275,739 | 9/1966 | Eager, Jr. | 174/102 R |
| 3,539,709 | 11/1970 | Brancaleone | 174/75 C |
| 3,551,882 | 12/1970 | O'Keefe | 174/75 C |
| 3,701,086 | 10/1972 | Somerset | 174/75 C |
| 3,982,060 | 9/1976 | Avery et al. | 174/75 C |
| 4,503,284 | 3/1985 | Minnick et al. | 174/36 |
| 4,626,618 | 12/1986 | Takaoka et al. | 174/105 SC |
| 4,698,028 | 10/1987 | Caro et al. | 439/578 X |
| 5,061,823 | 10/1991 | Carroll | 174/106 R X |

*Primary Examiner*—Morris H. Nimmo

*Attorney, Agent, or Firm*—Hamilton, Brook, Smith & Reynolds

[57] ABSTRACT

A high-temperature, low-noise coaxial cable assembly with high strength reinforcement braid is depicted and described. The cable assembly has very low self-noise generation and is particularly useful for telemetry and instrumentation purposes. Also, the cable assembly offers a tensile strength about an order of magnitude greater than conventional cable assemblies, and resultant improved service life and durability.

15 Claims, 2 Drawing Sheets

Figure 1:
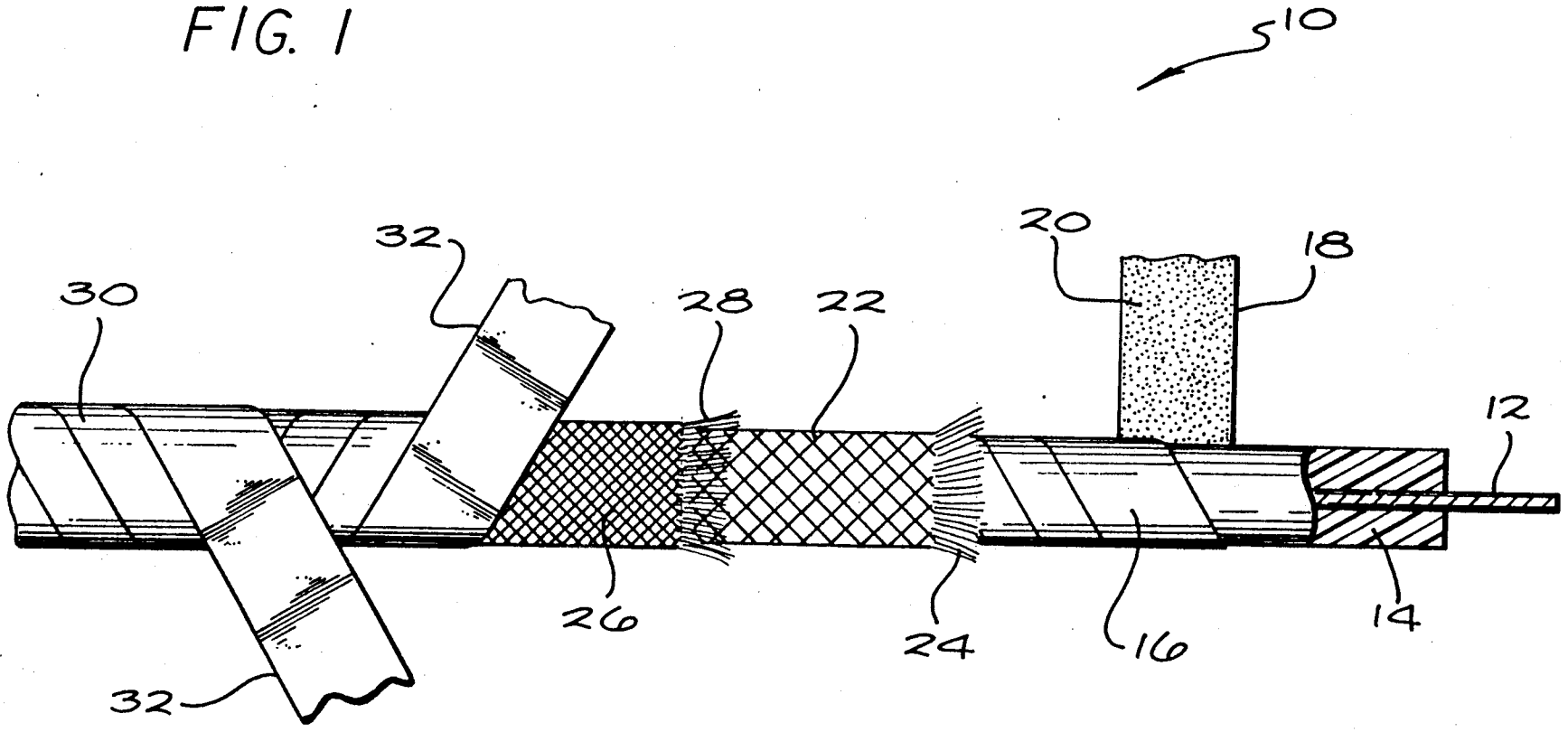

HIGH-TEMPERATURE, LOW-NOISE COAXIAL CABLE ASSEMBLY WITH HIGH STRENGTH REINFORCEMENT BRAID

The present invention relates to an electronic cable assembly particularly useable for transmitting high-precision electronic telemetry signals. More particularly, the present invention relates to such a cable assembly which is of the coaxial-type, and combines the desirable attributes of low self-noise generation, ability to withstand use in low as well as high temperatures, and a high-strength end termination superior over conventional cable assemblies by a factor of about an order of magnitude.

Low-noise, durable cable assemblies are needed for a variety of telemetry and electronic measurement uses. In many applications the cable assemblies must endure low or high temperatures, in-use vibrations, and installation manipulation, while still remaining very low in self-noise generation. A cable assembly which generates self-noise in response to temperature changes, vibration, handling, etc., will adulterate the measurement signal transmitted over the cable. In extreme cases, the signal-to-noise ratio may become so unfavorable that the value of the telemetry or measurement data is compromised or even rendered useless. In addition to low noise characteristics, the cable must not affect transducer or test specimen characteristics. Good transducer cables are as small, light mass, and flexible as possible. Stiff or massive cables can severely distort frequency response performance.

Another problem with currently available cable assemblies of the type with which the present invention is concerned is their comparatively fragile end termination structures. The present conventional cable assemblies have an end-termination pull-out separation strength as low as 15 lbs. tension. In the event a technician installing or servicing a device employing a conventional cable assembly inadvertently applies a little too much tension to the cable, the end termination will be separated, and the assembly destroyed.

An example of a common, but severe use environment in which conventional telemetry cable assemblies are found wanting is presented by the aerospace industry. In modern turbofan-powered passenger aircraft monitoring the health and operating characteristic of the propulsion engines is of great importance to passenger safety and comfort. A primary way in which these engine parameters are measured is by vibration accelerometers installed at various locations within the engines themselves. By establishing benchmark vibration levels both for an engine type as well as for individual engines, and monitoring the vibration levels of an engine during its life, both in relation to the engine type benchmarks and the early-life levels of the individual engine, an excellent present-health and predictive indicator is obtained.

However, the environment within a propulsion turbine engine includes both low and high temperatures, engine and aerodynamic buffeting vibrations, and exposure to manipulation and handling as the engine is inspected and serviced. In these uses, conventional telemetry cable assemblies have fallen far short of the desired service levels.

Accordingly, the present invention provides a coaxial cable assembly of uniquely low self-noise generation, which is able to endure both low and high temperature conditions, and which includes a high-strength reinforcement braid providing both a tensile strength for the cable well above the conventional, and for a high-strength end termination for a cable assembly. The end termination of the cable assembly includes a hermetic termination connector body which may threadably secure to an accelerometer, for example, in sealing relation, and to which the cable is joined electrically and in high-strength mechanical attachment.

Figure 2:
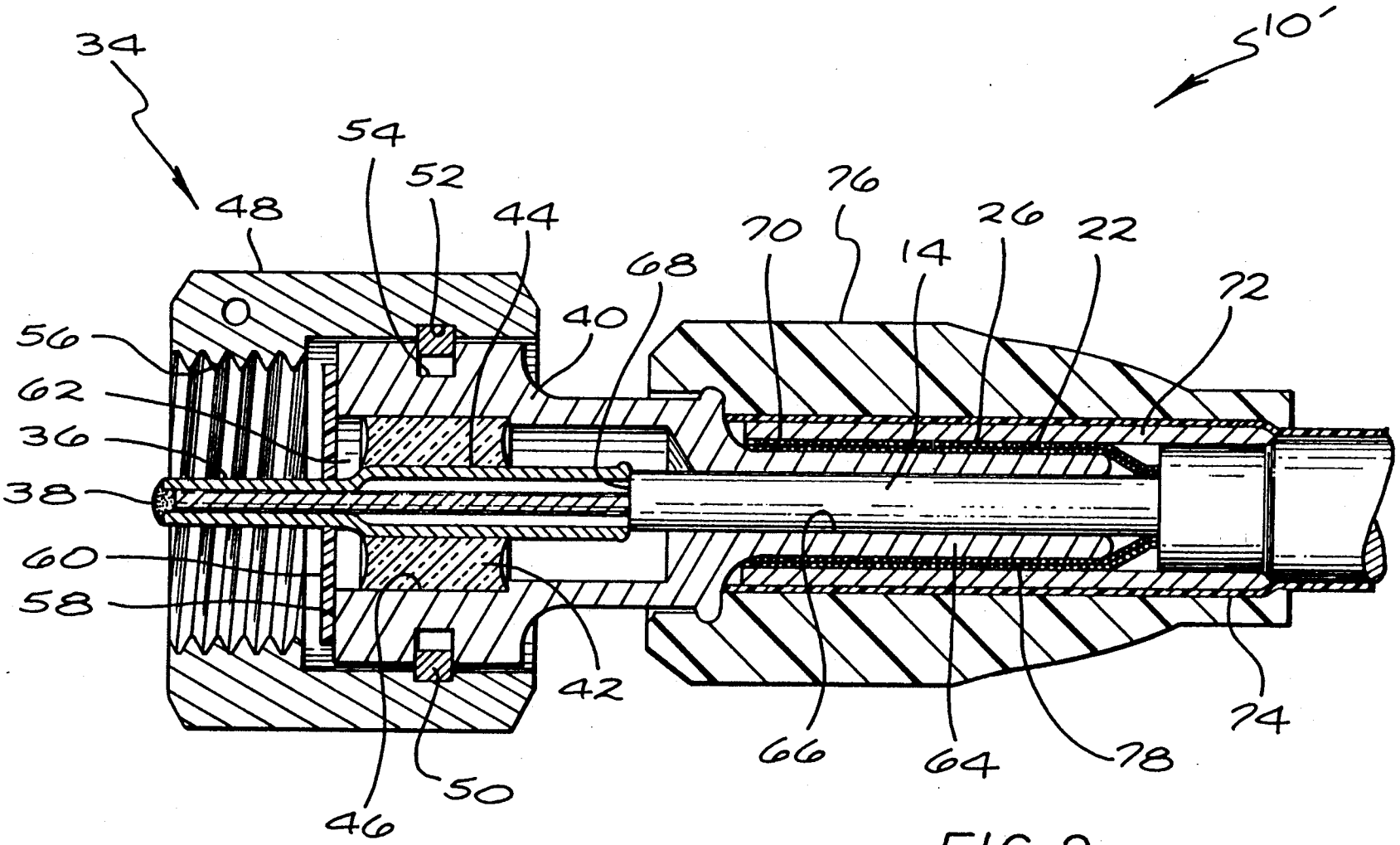

Additional objects and advantages of the present invention will be apparent from a reading of the following description of a single preferred embodiment of the invention, taken in conjunction with the following drawing figures, in which:

FIG. 1 is a fragmentary longitudinal view, partially in cross section, of a cable according to the invention, with various cable structures moved aside in manufacturing sequence to show underlying structures; and FIG. 2 is a fragmentary longitudinal view, partially in cross section, of a cable as depicted in FIG. 1 combined with a unique end termination structure to form one end of an elongate cable assembly.

Viewing now FIG. 1, a coaxial cable 10 includes a stranded center conductor 12 which may be of 30 AWG size. The 30 AWG size is made up of seven strands (six around one) of 38 AWG copper-weld wire (steel wire with a thin copper coating). The center conductor 12 may be of twisted, or bunch-stranded construction, and may be tinned or plated to prevent the individual strands from rubbing against one another during cable vibration, thus eliminating a source of self-noise.

Concentrically applied around the center conductor 12, preferably by hot melt extrusion, is a dielectric of polytetrafluoroethylene (PTFE), generally known under the trade name of Teflon. In order to provide a second conductor about the dielectric 14, the cable 10 includes a spiral-wrapped layer 16 of PTFE tape 18 in which carbon particles, generally referenced at 20, are dispersed. The carbon particle 20 are in fact of powder-fine size, but are depicted for purposes of illustration as being of discreet size. As will be described further hereinbelow, the layer 16 of tape 18 is fused to itself in its successive wraps so that it becomes essentially a continuous electrostatically-conductive layer, and loses its spiral-wrapped nature. The fused continuous-layer nature of the tape layer 16 prevents buildup of local charges during mechanical separation from the shield. This treatment therefore greatly reduces triboelectric noise.

Tightly applied over the tape layer 16 is a metallic braid 22 of nickel plated 38 AWG copper wire 24. The braid 22 includes 16 strands, each of four wire ends (48 total wires), and achieves 90% coverage in the preferred embodiment. Also tightly applied over the braid 22, is a second braid 26 of high-strength synthetic filamentary material 28. In the preferred embodiment, the filamentary material 28 is Kevlar (aromatic polyamide) fiber, and the braid 26 includes sixteen strands each of four ends (48 total fiber ends).

Finally, the cable 10 includes an outer jacket layer 30 of PTFE. Preferable, the layer 30 is formed by tightly spiral-wrapping at least one, and preferably two, PTFE tapes 32, and fusing the spiral-wrapped tapes to form a substantially continuous layer 30. Additionally, when the spiral-wrapped tape 32 is fused, it shrinks slightly to hold the braid 26 tightly upon the braid 22, with the latter braid in radial compression upon the electrostatically conductive layer 16. The applicant believes that because the wires 24 of braid 22 are held securely in their relative positions, with rubbing of the wire strands against one another inhibited, and with all of the wires 24 in radially compressive electrical contact with the electrostatically-conductive layer 16, yet another possible source of cable self-noise is eliminated.

In order to fuse the spiral-wrap tape layers 16, 28, the tape is spiral-wrapped cover the underlying structure, and the partially completed cable is exposed to a short-duration, intense, externally-applied heat source. One way in which this fusing of tape layers may be accomplished is to run the partially completed cable assembly length-wise through a comparatively short high-temperature oven. The short-duration, high-temperature oven exposure will heat the outer layer of the cable without increasing the inner temperature appreciably. Thus, the tape layers 16, 28, may be individually fused. The fusing step may be followed immediately, if desired, by a quenching step, as with fan-blown ambient air, further preventing heat soaking into the internal cable structure.

Viewing now FIG. 2, the cable 10 is depicted as part of a cable assembly 10'. Cable assembly 10' preferably includes an end-termination assembly 34 at each end of the cable assembly. The assembly 34 includes a tubular center contact pin 36 into which the center conductor 12 is received and is welded at 38 to form a hermetic seal. Center contact 36 is concentrically secured and hermetically sealed into a tubular connector body 40 by a glass preform bead 42. That is, the bead 42 sealingly engages both the outer surface 44 of contact pin 36, and the stepped inner surface 46 of connector body 40.

In order to attach the connector body to an electrical connector (not shown) the body 40 carries a freely rotatable coupling nut 48. Coupling nut 48 is captively retained in freely rotatable relation on the body 40 by a resilient ring member 50 captured in congruent grooves 52, 54 in the sleeve member 48 and body 40, respectively. Coupling nut 48 also includes a female thread-defining portion 56 threadably engageable with the matching connector (not shown) to draw a sealing axial surface 58, upon which gasket 60 is disposed, into sealing engagement. Thus, a sealed cavity, generally referenced with numeral 62 is defined, within which the center electrode may electrically connect with the matching connector (not illustrated). Importantly, the cavity 62 is substantially sealed to exclude environmental contaminants which might degrade the quality of electrical connection between center electrode 36 and the matching connector (not shown).

In order to mechanically secure the cable 10 to end termination assembly 34, and to complete the electrical connection, the connector body 40 defines an elongate sleeve-like extension portion 74. This sleeve extension diameter is minimized to prevent bending the reinforcement braid at the sleeve crimp area. A large transition angle will greatly reduce the termination strength. The PTFE dielectric 14 is snugly received within a small-diameter portion 66 of the stepped inner diameter surface 46 of the connector body 40. An end edge 68 of the dielectric abuts a confronting end of the center contact pin 36. Around the outer surface 70 of the extension 64 are disposed, in radial succession, the metallic braid 22, fiber braid 26, a crimping sleeve 72, a heat-shrink environmental protective sleeve 74, and a protective handling sleeve 76.

An important feature of the cable assembly 10' is the abrasive grit-blast surface treatment of the surface 70, which is not visible in the illustration. This surface treatment improves the electrical contact of braid 22 with the connector body 40, improves the mechanical engagement of their braid with the body 40 under the compressive radial force from crimping sleeve 72, and improves the adhesion provided at this interface by an epoxy adhesive (depicted generally with numeral 78) which infiltrates the braids 22 and 26 between the crimping sleeve 72 and surface 70. Environmental closure of the end termination assembly 34 is provided by heat-shrink sleeve 74, while manual handling protection is enhanced by sleeve 76.

The Applicant has built and tested cable 10 and cable assemblies 10' as depicted and described above. The finished cable assemblies 10' show a self-noise generation as low as or lower than the best conventional instrument cable now available. However, in contrast to these conventional cables, which have an end termination pull out strength as low as 15 pounds, the applicant's cable assembly will sustain a pull of nearly 150 pounds at assembly 34 before separation. Thus, the inventive cable assembly 10' offers vastly improved in-use endurance and rugged ability to survive accidental or careless misuse.

I claim:

1. A coaxial cable having a center conductor concentrically surrounded by a dielectric layer, said cable further comprising a continuous electrostatically conductive polymer layer including a spiral wrap of fused PTFE polymer tape having powder-fine carbon particles dispersed therein surrounding said dielectric layer, a conductive metallic wire braid over said electrostatically conductive layer, a high-strength fibrous braid over said wire braid, and means including a spiral wrap of fused nd heat-shrunk PTFE polymer tape, for applying a radially compressive force to said wire braid everywhere along its length, thereby to both inhibit relative movement of the wires of said wire braid and to insure their intimate electrical contact with said electrostatically conductive layer.

2. A coaxial cable assembly comprising:

a center conductor concentrically surrounded by a dielectric;

a concentric electrostatically conductive layer surrounding said dielectric;

a high-strength fibrous braid over said electrostatically conductive layer;

an end termination assembly having a center contact pin connecting with said center conductor and a connector body connecting separately with said electrostatically conductive layer and insulated from said center electrode, and mechanical attachment means attaching said fibrous braid with said connector body to sustain tensile forces applied to said cable assembly.

3. The invention of claim 2 wherein said mechanical attachment means includes said connector body defining a tubular extension receivable between said dielectric and said fibrous braid, and a radially compressive crimping sleeve member surrounding said fibrous braid congruent with said extension and compressing said fibrous braid into mechanical engagement with said extension.

4. The invention of claim 3 herein said mechanical attachment means further includes an adhesive impregnating said fibrous braid at said tubular extension and adhering to the latter.

5. The invention of claim 4 further including said tubular connector body extension defining an outer surface confronting said fibrous braid, and said surface having an irregular extended surface treatment to enhance adhesion thereto of said adhesive.

6. A method of making a high-temperature, low-noise, high-strength coaxial instrumentation cable, and method comprising the steps of:

providing a center conductor with a concentric layer of high-temperature dielectric therearound;

spiral-wrapping a layer of carbon-dispersed PTFE tape onto said dielectric, and heat-fusing said carbon-dispersed tape to provide a continuous electrostatically-conductive layer over said dielectric;

providing a metallic wire braid followed by a high-strength fibrous braid onto said electrostatically conductive layer; tightly spiral-wrapping PTFE tape onto said fibrous braid, and heat-fusing said tape to further apply radially compressive force inhibiting relative movement of the wires of said wire braid while urging the latter into electrical contact with said electrostatically conductive layer.

7. The method of claim 6 further including the steps of providing an end termination assembly with a center contact pin insulated from a tubular connector body; electrically connecting said center conductor to said center contact pin and said metallic braid to said connector body; and further mechanically securing said high-strength fibrous braid to said connector body so as to sustain tension forces applied to said cable.

8. The method of claim 7 wherein said mechanical securing step further includes capturing said high-strength fibrous braid in radial compression between said connector body and a crimp sleeve, and also adhesively securing said high-strength fibrous braid to said connector body.

9. A high-strength, high-temperature,low-noise coaxial instrumentation cable comprising:

a stranded center conductor of copper coated steel wire;

a concentric dielectric layer of PTFE on said center conductor;

a continuous electrostatically conductive PTFE polymer layer surrounding said dielectric;

a metallic wire braid surrounding said PTFE polymer layer, a high-strength fibrous braid surrounding said metallic braid;

and an outer jacket layer of PTFE surrounding said fibrous braid and applying radially compressive force thereto and to said metallic braid to inhibit relative movement of the wires thereof as well as urging the latter into electrical contact with said electrostatically conductive PTFE polymer layer.

10. The invention of claim 9 wherein said electrostatically conductive polymer layer includes powder-fine carbon particles dispersed in PTFE polymer.

11. The invention of claim 9 wherein said high-strength fibrous braid includes fibers of aromatic polyamide.

12. The invention of claim 9 wherein said PTFE jacket includes a spiral-wrap of heat-fused and heat-shrunk PTFE tape applied around said metallic braid.

13. A cable assembly including a cable according to claim 8, and further including an end termination assembly, said end termination assembly having a center contact pin sealingly carried concentrically in a tubular connector body, said center conductor electrically and sealingly secured to said center contact pin, said connector body including a tubular extension receiving therearound said metallic braid and said fibrous braid, said metallic braid electrically connected with said connector body and said fibrous braid mechanically coupled to said connector body.

14. The invention of claim 13 wherein said fibrous braid is compressively captured upon said tubular extension and urges said metallic braid into electrical connection therewith.

15. The invention of claim 14 further including adhesive permeating said fibrous and metallic braids at said tubular extension and adhering to the latter.

* * * * *